United States Patent [19]

Westwinkel

[11] Patent Number: 5,062,678

[45] Date of Patent: Nov. 5, 1991

[54] FLEXIBLE ANTI-TIPPING MECHANISM

[75] Inventor: Florian Westwinkel, Toronto, Canada

[73] Assignee: Pundra Indostries Limited

[21] Appl. No.: 662,015

[22] Filed: Feb. 28, 1991

[51] Int. Cl.[5] ..... E05C 7/06

[52] U.S. Cl. ..... 312/221

[58] Field of Search ..... 312/216–221

[56] References Cited

U.S. PATENT DOCUMENTS

Re. 26,902 5/1970 Levenberg ..... 312/221

1,238,514 8/1917 Hartbeck ..... 312/221

*Primary Examiner*—Joseph Falk

*Attorney, Agent, or Firm*—Blake, Cassels & Graydon

[57] ABSTRACT

A latching mechanism for stacked drawer arrangements comprises operating parts for each drawer which are mounted on the drawer slide for the respective drawer. Such an arrangement may allow any arrangement of drawers of different depths in a cabinet because no actuating parts are provided at fixed intervals on the cabinet. A flexible band having slack length therein is provided on the cabinet over its height. The band is deflectible by the actuating parts when a drawer is withdrawn to take up the slack length. Thus, when one drawer is withdrawn, no slack length is available to allow withdrawal of another drawer. Guides are provided on the drawer slides to maximize deflection of the band.

19 Claims, 2 Drawing Sheets

FLEXIBLE ANTI-TIPPING MECHANISM

BACKGROUND OF THE INVENTION

1. Field of the Invention

This invention relates to latching mechanisms for stacked drawer arrangements, for example, in filing cabinets, which mechanisms act to allow withdrawal of only one drawer at a time. Such arrangements are intended to maintain the stability of the stack against tipping.

2. Description of the Prior Art

The provision of anti-tip latching arrangements has presented a large number of practical problems and a large amount of prior art exists. Generally, anti-tip mechanisms require great precision in installation of the anti-tip interactive components secured, for example, to a filing cabinet, and of the related actuating pins carried by the cabinet drawers.

Many conventional arrangements utilize vertical rigid bars, associated with the drawers. In one such conventional arrangement, each drawer is associated with a single vertical bar of similar height to the height of the respective drawer. Each bar is itself associated with a stop to prevent withdrawal of its associated drawer. The bars and their stops are positionable such that all the stops except one are located to block withdrawal of their respective drawers.

In the second conventional arrangement, each drawer is associated with a pair of vertical, rigid bars (split bars), each pair being associated with a stop for the respective drawer. The system works in a somewhat similar manner to that described for the first system, but this second system may be more versatile in that each stop may be located at the junction between bars of each pair and the length of each bar of the pair may be selected at will. Pratzer U.S. patent application Ser. No. 384,792 and assigned to the same assignee as the present invention, discloses and claims such a system.

Other patents representative of the art utilizing rigid bars are U.S. Pat. No. 4,768,844 issued Sept. 6th, 1988 to Ludwig and U.S. Pat. No. 4,429,993 issued February 1984 to Blouin.

Another known arrangement utilizes a flexible ribbon rather than rigid bars. When all the drawers are closed the ribbon has some slack in it. When one drawer is pulled in the opening direction a lug associated with the drawer actuates a cam to take up the slack of the ribbon to tauten it, and to allow the drawer to open. No further slack is available to be taken up by other similar cams associated with other drawers. The tautened ribbon blocks actuation of these other cams preventing opening of the associated drawers. Such an arrangement is described in U.S. Pat. No. 3,799,638 issued Mar. 26th, 1974 to Faiks which discloses a system in which the slack take-up mechanism is fixed in relation to the cabinet thus fixing the relative locations of the drawers. In practice, arrangements utilizing flexible ribbon have not been as widely used as those using rigid bars. One possible reason is that accuracy and reliability may have been less easy to achieve using a flexible ribbon which may be subject to stretching or elongation or contraction due to temperature related changes in length of the ribbon. Since very small lengths of slack have been permissible, change of length of the ribbon could be of significance.

The mechanisms of all the previous mechanisms known to the applicant have involved the provision of structure defining the location of drawers and cooperating structure on the drawers. It would be desirable to be able to rearrange the location or drawers, say drawers of different depths, without the need for any specialist procedures or the use of special tools.

SUMMARY OF THE INVENTION

The present inventor has addressed the problem of providing an anti-tipping drawer interlock for vertically stacked drawers, e.g, in a filing or other cabinet, in which a slack take up of a flexible member is utilized to block withdrawal of more than one drawer at a time. He has addressed the problems of providing an improved system of slack take up which permits improved slack control and accuracy, and the provision of a system in which the drawers may be easily rearranged without having the need to detach or reattach mechanism in the cabinet frame.

According to the invention, there is provided a drawer interlock associated with drawer slides for use in a stack of vertically stacked drawers, each drawer being withdrawable from and retractible into the stack and rearrangeable with vertical location in the stack by a drawer slide having at least an inner slide member attachable to the drawer and an outer slide member attachable to a frame for the stack, the interlock comprising: an elongate flexible member mountable on the frame to extend over at least the height between drawer slides, the flexible member being deflectable between slack and taut positions; an actuating member rotatably attached to each outer slide member to be rotatable between first and second positions and located with respect to the flexible member such that, in the first position, the flexible member is in its slack position and, in the second position, the flexible member is deflected into its taut position, the flexible member having a length such that when any one actuating member is deflected into its second position the flexible member in its corresponding taut position restricts movement of any other actuating member into its second position; means associated with the inner slide member to rotate the actuating member into its second position on withdrawal of the respective drawer from the stack and rotate the actuating member into its first position on retraction of the respective drawer into the stack; at least one guide associated with the drawer slide connected to each outer slide member configured to confine deflection of the flexible member within a prechosen height on rotation of the respective actuating member into its second position.

The slack of the flexible member may be taken up by a spring extension of which corresponds to a permissable amount of slack in the flexible member and against the bias of which any one actuating member is rotatable on withdrawal of the respective drawer. The flexible member may be an endless band having parallel, vertical forward and rear elongate runs. In this case each actuating member may be located, between the runs to deflect each of them in opposing directions on rotation from its first position into its second position.

The means to rotate the actuating member may be any convenient means operated by withdrawal and retraction of the drawer itself. Conveniently it may comprise a lug attached to the inner slide member and a cam rotatable with the actuating member. On withdrawal of a drawer, the lug will rotate the cam and hence the actuating member which will move from its first position into its second position. On retraction of the drawer the cam will rotate in the opposite direction and return the actuating member to its first position.

Conveniently, the cam and the actuating member are located on opposing end portions of a pivot shaft which pivots in a support plate parallel with the drawer slide and spaced from it. The actuating member may be located on the outer end of the shaft, e.g. between the support plate and the cabinet wall. There may be sufficient space in this region to mount the flexible member on the cabinet so that rotation of the activating member will bias it to take up the slack. The cam may be located at the inner end of the pivot shaft in the space between the support plate and the outer slide member. It may rotate in this vertical space and project upwardly, or conceivably downwardly, of the outer slide member. If the lug similarly projects upwardly and is bent over outwardly so that it contacts the cam in its travel it may act to rotate the cam in either direction.

Stops may be provided to limit rotation of the cam in either direction, the stops being located to define the first and second positions of the actuating member. Conveniently the support plate may be the web of a U-shaped bracket connected at the free ends of its legs to the outer slide member. In this case the legs of the U bracket may act as stops for the cam.

The guide to confine deflection of the flexible member within a prechosen height is an important feature of the invention. Such guide prevents generalized bowing of the flexible member and may cause its deflection to be specific and accurate. Suitably, such a guide is provided for both forward and rear elongate runs for the flexible member.

The guide for each run may comprise a pair of upper and lower pins projecting outwardly from the support into the path of movement of the respective run, the vertical distance between the pins of each pair corresponding to the prechosen height. Suitably, the prechosen height is chosen to adjust the slack in the flexible member for accuracy. The actuating member, in its second position should take up the slack securely so that the member is taut. Thus, for maximum accuracy the length of slack take-up necessary to allow the drawer to open should be as large as is reasonably possible and it should be confined to the region of the respective drawer. In practice, it may be convenient to position the pins a distance apart substantially the same as the height of the drawer slide or support plate. In practice, the height of the support plate may be the same as that of the slide but it may be made greater or less if desired.

The actuating member must, of course, have room to rotate into its second position. Conveniently, the actuating member comprises a substantially rectangular bar attached to the pivot shaft to extend symmetrically in both directions therefrom and having a depth to project between the runs of the endless band and a length substantially corresponding to the vertical distance between the pins, the actuating member being located parallel between the runs in its first position and at right angles thereto in its second position. The bar conveniently has rounded ends for ease of action against the flexible member.

The flexible member may be made of any suitable material e.g. plastics or metal material. The degree of stretch or coefficient of expansion must be chosen with some care. The member may be either a cable or a ribbon or be in any other convenient elongate form. When the member is a ribbon its plane should be at right angles to the drawer slide for maximum engagement with the actuating member and with the guide pins.

BRIEF DESCRIPTION OF THE DRAWINGS

An embodiment of the invention will now be described by way of example with reference to the drawings, in which.

DETAILED DESCRIPTION OF A PREFERRED EMBODIMENT

Figure 2:
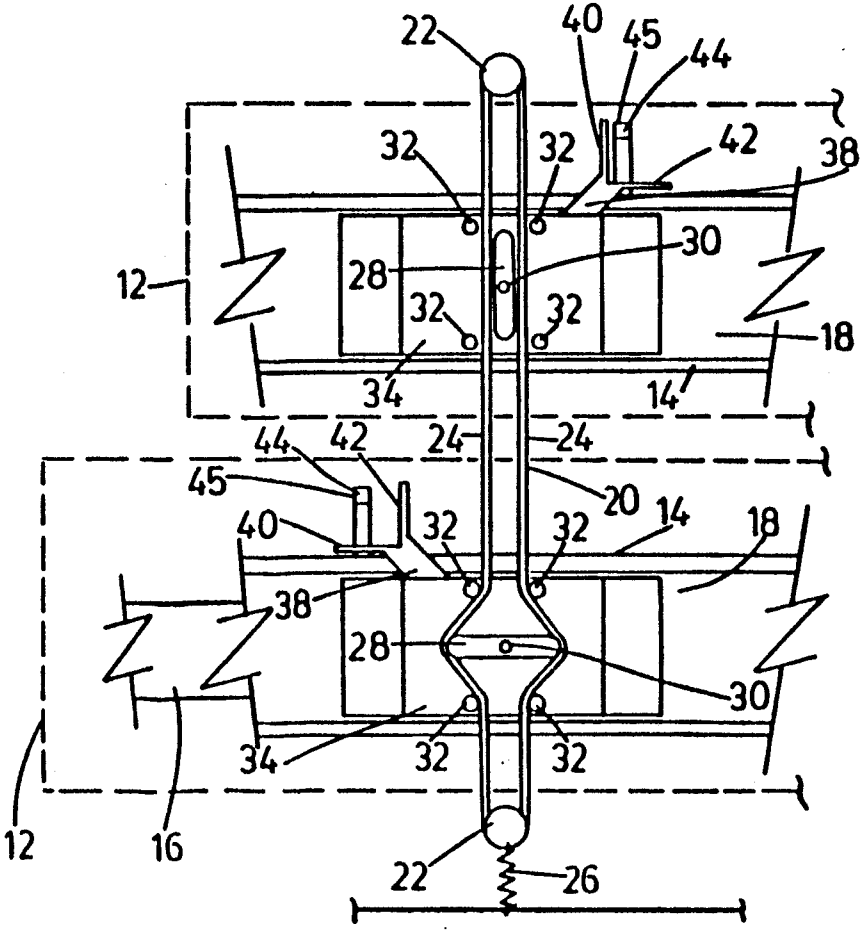
FIG. 2 shows a similar schematic view of the arrangement of FIG. 1 with the lower drawer withdrawn.

In the drawings a cabinet 10 has two vertically stacked drawers 12 therein. It will, however be appreciated that any suitable number of drawers may be provided. In filing cabinets, four drawers are quite frequent. The drawers 12 are mounted to the cabinet 10 by means of drawer slides 14 each comprising at least an inner slide member 16 carrying the drawer 12 and an outer slide member 18 mounted on the cabinet 10. In practice the drawer slide will usually comprise at least three sliding members but only the inner member for attachment to a drawer and an outer member for attachment to the cabinet are pertinent to the present invention. There is some clearance between the outer slide member 18 and a vertical wall of cabinet 10 to house the mechanism of the invention as described hereinafter.

In the illustrated embodiment, the anti-tipping interlock comprises a flexible endless band 20, which may be formed from any suitable material, for example, a steel or, possibly, some plastics materials. As illustrated the band 20 is shown as a tape or ribbon but it will be appreciated that a rope or cable will be an alternative.

The band 20 is arranged between the top and bottom of cabinet 10 on pulleys 22 so that any tension or slack is distributed between runs 24 of band 20. A spring 26 acts on the band between the lower pulley 22 and the floor of the cabinet 10 to take up slack in the band 20. A stop 21 is provided to ensure that the spring does not extend for a distance beyond the permited slack length of band 20.

Between the runs 24 of the band 20, a rotatable actuating member 28 projects. This actuating member 28 comprises a slightly elongate rectangular lug having rounded ends projecting over a depth sufficient to project between runs 24 and, on rotation, act to move them out of the position shown in FIG. 1. Actuating member 28 is symmetrically rotatable about its mid point with pivot shaft 30 to which it is fixed.

A pair of upper and lower guide pins 32 is provided for each run 24 in the vicinity of actuating member 28. The guide pins are arranged so that each run 24 is slotted between the actuating member 28 and the respective pair of guide pins 32 and the pins of each pair are sufficiently spaced apart to allow rotation of actuating member 28 into the position of FIG. 2, thus deflecting the runs 24 between the respective pins 32 in order to take up slack in band 20 against the bias of spring 26.

The pivot shaft 30 is rotatable in a support plate 34 formed by the web of a U-shaped bracket. The bracket is attached, at the free ends of the legs 36 of the U, to outer slide member 18 such that support plate 34 is parallel to slide member 18. The pivot shaft 30 is caused to rotate by the action of opening or closing one of the drawers 12 which acts on a respective cam 38 fixed to pivot shaft 30. Cam 38 is located on the other end portion of pivot shaft 30 to the end portion on which actuating member 28 is located. Thus, actuating member 28 is located to the outer surface of support plate 34 and cam 38 is located to the inner surface of support plate 34.

Cam 38 comprises an elongate arm extending in a vertical plane between the parallel vertical planes of the support plate 34 and the slide member 18. Thus, rotation of cam 38 is constrained by legs 36 of the U-shaped bracket from complete rotation and is only permitted to rotate in the arc described between legs 36. In practice, for rotation of actuating member 28 through 90°, this arc is 90° also. At the free end of cam 38, two cam surfaces 40, 42 are provided in the path of travel of a lug 44 located on the inner slide member 16 and moveable with the opening and closing of drawer 12. Conveniently, lug 44 upstands from inner slide member 16 and has a bent over or horizontally projecting portion 45 which engages a respective camming surface 40 or 42 according to the direction of movement of lug 44. Camming surfaces 40 and 42 are suitably formed by plates located at an appropriate angle one to the other for engagement by lug 44 to rotate cam 38 through its arc of movement. The angle between cam surfaces 40, 42 may be 90° for corresponding movement of the cam 38 and acuating member 28 through 90°.

Figure 3:
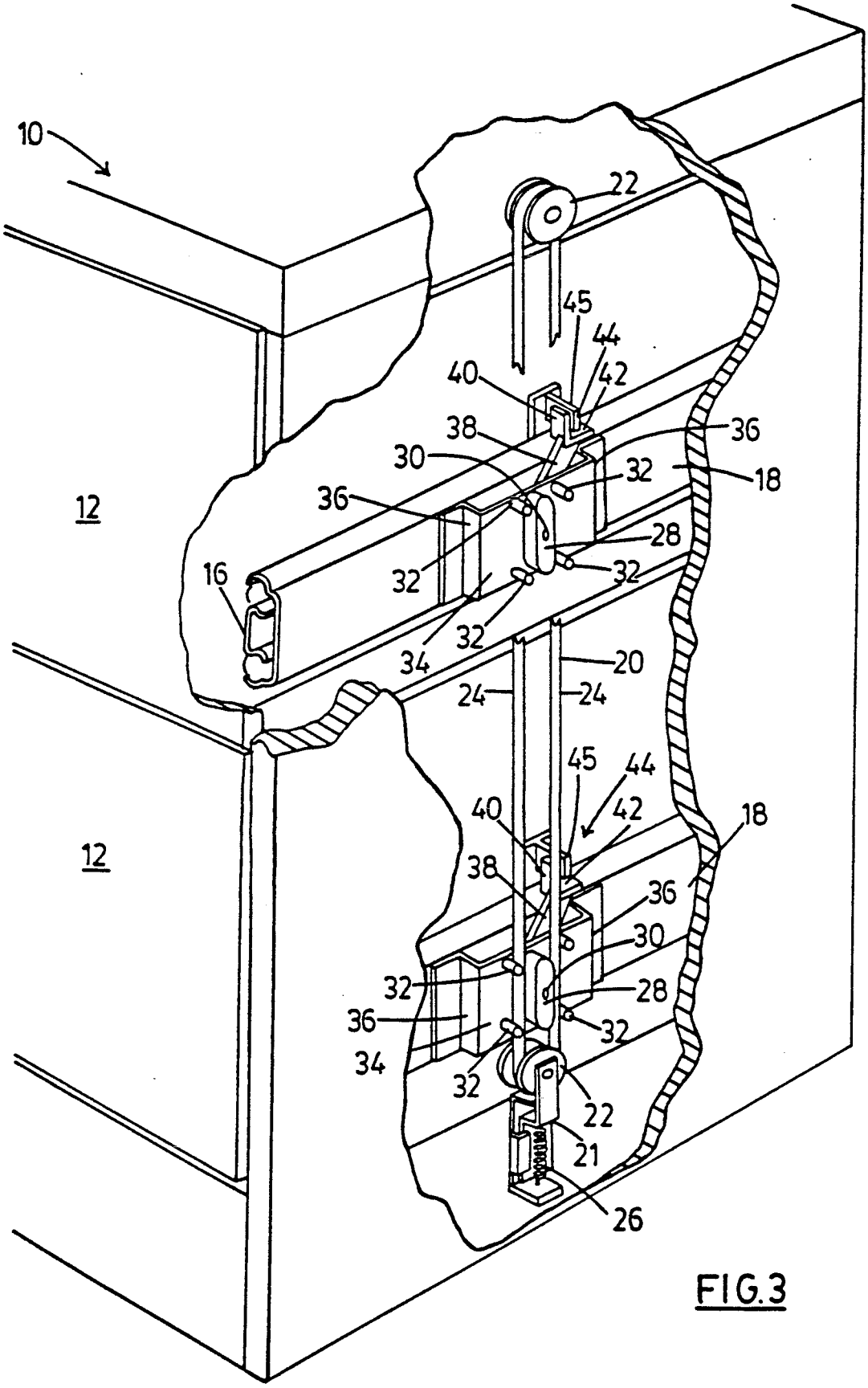
FIG. 3 shows perspective view of one drawer fitted with a drawer slide as shown in FIGS. 1 and 2.

In operation, on initial withdrawal or opening movement of a drawer 12, lug 44 engages cam surface 40. On further opening movement of drawer 12, lug 44 acts to bear on cam surface 40 to rotate cam 38 from the position shown in FIG. 1 to that shown in FIG. 2 with corresponding rotation of pivot shaft 30 and actuating member 28. Initially, cam surface 40 is located for engagement with lug 44 by a lug by a locator stop formed by the upper edge of one leg 36 of the U-shaped bracket. At the end of travel of cam 38 (in the drawer withdrawing direction), cam surface 40 is horizontal as shown in FIGS. 2 and 3, and cam 38 is restrained from further rotation in the same direction by the upper edge of the other leg 36 of the U-shaped bracket. In this position cam surface 42 is properly located for engagement with lug 44 in the reverse direction. Since cam surface 40 is now horizontal, drawer 12 may be further withdrawn to draw lug 44 away from cam 38 with no further action on it.

Figure 1:
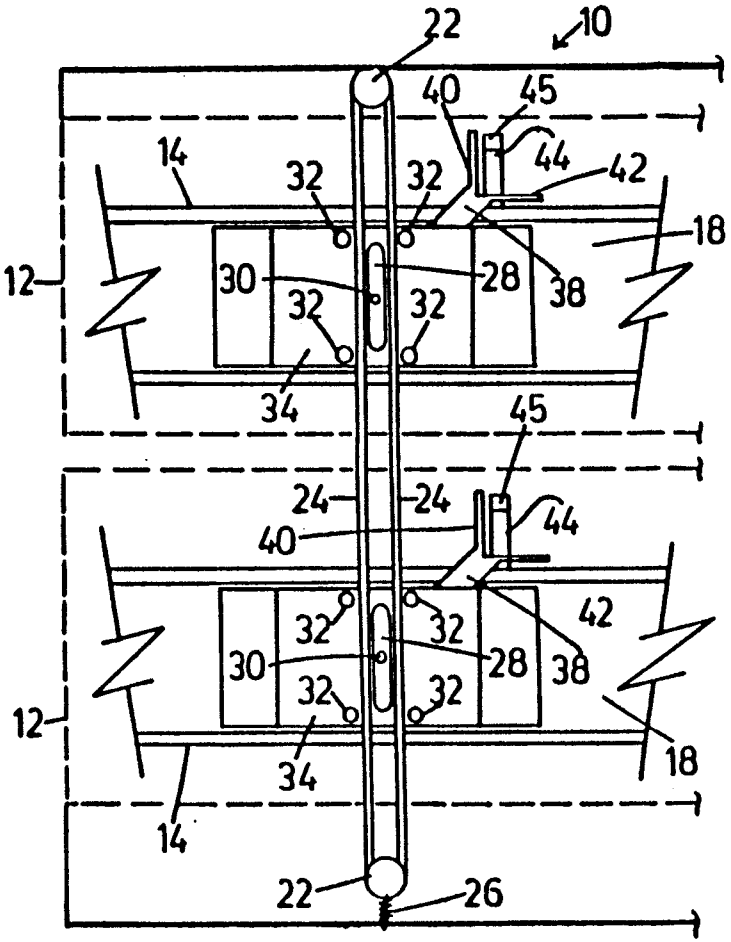
FIG. 1 shows a schematic view of an arrangement of the invention for a two drawer stack, with the drawers retracted.

The above described rotation of cam 38 through 90° results in corresponding rotation of pivot shaft 30 and actuating member 28. The actuating member 28 moves from the position shown in FIG. 1 in which it is parallel with runs 24 of band 20 to the position shown in FIG. 2 and FIG. 3 in which it is at 90° to the general direction of the runs 24. This causes the runs 24 to be guided between the respective pairs of pins 32 and take up the slack in band 20. In FIG. 1, the available slack is absorbed by spring 26 to keep the band 20 from actual sloppiness. The precise tension of spring 26 is not of importance provided that it may be overcome by movement of a drawer 12 without inconvenience to the user.

The slack in band 20 which becomes available on extension of spring 26 is equivalent to the length of extension of the spring 26. It is carefully chosen so that, on withdrawal of one drawer 12, the corresponding actuating member 28 may move into the position shown in FIG. 2 or 3 but so that other actuating members are not additionally permitted to move into such a position.

It will be seen that if the length of actuating member 28 is very short and the slack required is therefor minimal, any stretching or elongation in band 20 may allow another actuating member 28 to at least move through part of its arc of movement if an attempt is made to open the corresponding drawer when one drawer is already open. It may therefore be advantageous to choose a slack length and dependent actuating member 28 length and pin 32 separation of appropriate dimension. It may normally be considered suitable that such slack length in the range of about ½ inch. The pin separation and actuating member length may very generally correspond to the slack length and it is convenient that this may suitably be accomodated in the height of the outer slide member 18 or on the support plate 34. In terms of geometry, it will be seen that the slack length may be slightly greater than the pin separation and the length of the actuator member 28. In comparison with the total length of band 20, however, it may be convenient to regard the slack length, the pin separation and length of the actuator as generally similar.

On return of the drawer 12 into the cabinet, lug 44 will engage cam surface 42 and rotate cam 38 into its initial position as shown in FIG. 1 to make slack available in bend 20 by return of actuating member 28 to its original position also. Thereafter the same or another drawer 12 may be withdrawn.

Other modifications and variations within the scope of the invention will be obvious to one skilled in the art.

I claim:

1. A drawer interlock associated with drawer slides for use in association with a stack of vertically stacked drawers, each drawer being withdrawable from and retractible into the stack and rearrangeable in its vertical location in the stack, each drawer slide having at least an inner slide member attachable to the drawer and an outer slide member attachable to a frame for the stack, the interlock comprising:

an elongate flexible member mountable on the frame to extend over at least the height between drawer slides the flexible member being deflectable between slack and taut positions;

an actuating member rotatably attached to each outer slide member to be rotatable between first and second positions and located with respect to the flexible member such that, in the first position, the flexible member is in its slack position and, in the second position, the flexible member is deflected into its taut position, the flexible member having a length such that when any one actuating member is deflected into its second position the flexible member in its corresponding taut position restricts movement of any other actuating member into its second position;

means associated with the inner slide member to rotate the actuating member into its second position on withdrawal of the respective drawer from the stack and to rotate the actuating member into its first position on retraction of the respective drawer into the stack;

at least one guide associated with the drawer slide configured to confine deflection of the flexible member, within a prechosen height on rotation of the respective actuating member into its second position.

2. A drawer interlock as claimed in claim 1, in which, in the slack position of the flexible member, slack is taken up by a spring, the extension of which corresponds to a permissible amount of slack in the flexible member, and against the bias of which any one actuating member is rotatable on withdrawal of the respective drawer.

3. A drawer interlock as claimed in claim 2, in which the flexible member comprises an endless band having parallel forward and rear elongate runs, and in which each actuating member is located between the runs to deflect each of them in opposing directions on rotation into its second position.

4. A drawer interlock as claimed in claim 3, in which the means to rotate the actuating member comprises a lug attached to the inner slide member and a cam rotatable with the actuating member, the cam and the lug being respectively located such that the cam is rotatable in one direction by passage of the lug on withdrawal of a drawer and in the other direction by passage of the lug on retraction of a drawer.

5. A drawer interlock as claimed in claim 4 in which stops may be provided to limit rotation of the cam in either direction, the stops being located to define the first and second positions of the actuating member.

6. A drawer interlock as claimed in claim 5, in which the actuating member is pivoted at an outer surface of a support attached parallel to and spaced outwardly from the outer slide member.

7. A drawer interlock as claimed in claim 6, in which the actuating member is carried by the outer end portion of a pivot shaft extending between an outer surface of the support and inner surface of the support, and the cam is carried by an inner end portion of the pivot shaft.

8. A drawer interlock as claimed in claim 7, in which a guide on each outer slide member is provided for each of the forward and rear elongate runs to confine deflection of respective runs in opposing directions within the prechosen height.

9. A drawer interlock as claimed in claim 8, in which the guide for each run may comprise a pair of upper and lower pins projecting outwardly from the support into the path of movement of the respective run, the vertical distance between the pins of each pair corresponding to the prechosen height.

10. A drawer interlock as claimed in claim 9, in which each actuating member comprises a substantially rectangular bar attached to the pivot shaft to extend symmetrically in both directions therefrom and having a depth to project between the runs of the endless band and a length substantially corresponding to the prechosen height, the actuating member being located parallel between the runs in its first position and at right angles thereto in its second position.

11. A drawer interlock as claimed in claim 10, in which the flexible member is a cable.

12. A drawer interlock as claimed in claim 10, in which the flexible member is a ribbon having its plane at right angles to the drawer slide.

13. A drawer interlock as claimed in claim 6, in which the lug extends vertically and outwardly from the inner slide member and the cam comprises a bell crank lever having a pair of angled cam surfaces at a free end and being attached to the pivot shaft at the other end to rotate in a vertical plane on rotation of said shaft, the cam extending vertically from the outer slide member to locate one of said cam surfaces into the path of movement of the lug in one direction, and the other of said cam surfaces into the path of movement of the lug in the other direction.

14. A drawer interlock as claimed in claim 13, in which the cam surfaces are on orthogonal arms of the cam.

15. A drawer interlock as claimed in claim 6, in which the prechosen height is substantially the height of a drawer slide.

16. A drawer interlock as claimed in claim 6, in which the prechosen height is substantially the height of the support.

17. A drawer interlock as claimed in claim 14, in which the stops are provided by forward and rear attachment struts attaching the support to the outer slide member.

18. A drawer interlock as claimed in claim 6, in which the support is formed by the web of a U bracket attached to the outer slide member at free ends of its legs.

19. A drawer interlock as claimed in claim 18, in which the stops are provided by the legs of the U bracket.

* * * * *